US005595074A

United States Patent [19]

Munro

[11] Patent Number: 5,595,074

[45] Date of Patent: Jan. 21, 1997

[54] DESKTOP SECURITY LOCKING STATION FOR A LAPTOP COMPUTER OR SIMILARLY SIZED COMPUTER PERIPHERAL

[76] Inventor: Robert G. Munro, 5 George Crescent, Caledon, East Ontario Lonieo, Canada

[21] Appl. No.: 593,063

[22] Filed: Jan. 29, 1996

[51] Int. Cl.[6] ..... E05B 69/00

[52] U.S. Cl. ..... 70/58; 248/551; 248/553; 361/686; 70/19

[58] Field of Search ..... 70/63, 57, 58, 70/14, 18, 19; 361/685, 686; 248/551–553

[56] References Cited

U.S. PATENT DOCUMENTS

| | | | |
|---|---|---|---|
| 3,895,768 | 7/1975 | Scheck | 248/553 |
| 4,066,307 | 1/1978 | Barding | 248/553 X |
| 4,446,708 | 5/1984 | Ely | 70/19 X |
| 4,585,202 | 4/1986 | Parsekian | 248/553 |
| 4,603,829 | 8/1986 | Koike et al. | 248/553 |
| 4,627,589 | 12/1986 | Hotsumi | 248/553 X |
| 4,696,449 | 9/1987 | Woo et al. | 248/553 |
| 4,739,637 | 4/1988 | Finkel et al. | 248/553 X |
| 4,912,949 | 4/1990 | Bowers | 70/19 |
| 5,052,199 | 10/1991 | Derman | 70/19 X |
| 5,052,651 | 10/1991 | Guddee | 248/553 X |
| 5,169,114 | 12/1992 | O'Neill | 248/551 |
| 5,170,907 | 12/1992 | Sakai | 248/553 X |
| 5,314,162 | 5/1994 | Kelley | 248/553 |
| 5,325,263 | 6/1994 | Singer et al. | 361/685 X |
| 5,327,752 | 7/1994 | Myers et al. | 70/58 |
| 5,450,271 | 12/1995 | Fukushima et al. | 70/58 X |
| 5,477,415 | 12/1995 | Mitcham et al. | 361/686 |
| 5,504,649 | 4/1996 | Hosoya et al. | 361/686 |

*Primary Examiner*—Suzanne L. Dino

[57] ABSTRACT

A desktop security locking station for a laptop computer or similarly sized computer peripheral including a box-shaped platform having open forward and rearward compartments; a clamping mechanism coupled to a forward extent of the platform for securing the platform to a recipient object and being securable and releasable by access through the forward compartment only; a base plate disposed over the rearward compartment and coupled to the platform for holding a laptop computer or similarly sized computer peripheral thereupon; a ratcheting grip assembly mechanism disposed within the platform for holding a laptop computer or similarly sized computer peripheral in a fixed position and being securable and releasable by access through the forward compartment only; and a lockable door coupled to the platform and closable over the forward compartment to preclude access to the clamping and the ratcheting grip assembly mechanisms, thereby precluding the laptop computer or similarly sized computer peripheral from being released.

4 Claims, 5 Drawing Sheets

DESKTOP SECURITY LOCKING STATION FOR A LAPTOP COMPUTER OR SIMILARLY SIZED COMPUTER PERIPHERAL

BACKGROUND OF THE INVENTION

1. Field of the Invention

The present invention relates to a desktop security locking station for a laptop computer or similarly sized computer peripheral and more particularly pertains to preventing a laptop computer or a computer peripheral from being moved by an unauthorized person and thereby deterring its theft with a desktop security locking station.

2. Description of the Prior Art

The use of computer and computer peripheral locking devices is known in the prior art. More specifically, computer and computer peripheral locking devices heretofore devised and utilized for the purpose of preventing theft of computer equipment are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,154,456 to Moore et al. discloses a security locking bracket apparatus for a portable computer. U.S. Pat. No. 5,228,319 to Holley et al. discloses a desktop computer locking assembly. U.S. Pat. 5,264,986 to Ohgami et al. discloses an electronic apparatus equipped with detachable unit having retaining members, interlock, and locking cover plate. U.S. Pat. No. 5,325,263 to Singer et al. discloses a rack and pinion retaining and release device for removable computer components. U.S. Pat. No. 5,327,752 to Myers et al. discloses a computer equipment lock.

While these devices fulfill their respective, particular objective and requirements, the aforementioned patents do not describe a desktop security locking station for a laptop computer or similarly sized computer peripheral that allows a laptop computer or other similarly sized computer peripheral to be held in a fixed position on a desk or work station, thereby precluding its theft.

In this respect, the desktop security locking station for a laptop computer or similarly sized computer peripheral according to the present invention substantially departs from the conventional concepts and designs of the prior art, and in doing so provides an apparatus primarily developed for the purpose of preventing a laptop computer or a computer peripheral from being moved by an unauthorized person and thereby deterring its theft.

Therefore, it can be appreciated that there exists a continuing need for a new and improved desktop security locking station for a laptop computer or similarly sized computer peripheral which can be used for preventing a laptop computer or a computer peripheral from being moved by an unauthorized person and thereby deterring its theft. In this regard, the present invention substantially fulfills this need.

SUMMARY OF THE INVENTION

In the view of the foregoing disadvantages inherent in the known types of computer and computer peripheral locking devices now present in the prior art, the present invention provides an improved desktop security locking station for a laptop computer or similarly sized computer peripheral. As such, the general purpose of the present invention, which will be described subsequently in greater detail, is to provide a new and improved desktop security locking station and method which has all the advantages of the prior art and none of the disadvantages.

To attain this, the present invention essentially comprises, in combination, a rectangular box-shaped platform having a pair of front corners and a pair of rear corners. The platform also has a bottom wall with a pair of long side walls, a short front wall, and a short back wall extending upwards therefrom to define a hollow interior and a top opening. Each side wall has an elongated slot formed thereon. The platform further has an intermediate wall extended between the long walls to divide the interior into an open forward compartment and an open rearward compartment.

A pair of adjustable clamps is included and extended downwards from each front corner of the platform. Each clamp has a downwardly extended tubular seat portion integral with the bottom wall of the platform. Each clamp includes a bolt with a lower threaded portion extended downwards through the bottom wall and the seat portion and an upper head portion extended upwards into the forward compartment. Each clamp has a sleeve portion that is telescopically disposed within the seat portion and threadably engaged with the threaded portion of the bolt. A clamping arm is extended outwards from each sleeve portion. The head portion of each bolt is tightenable for allowing the associated clamping arm of each clamp to move upwards for clamping an object positioned between it and the bottom wall of the platform.

A ratcheting grip assembly is provided and disposed within the interior of the platform. The ratcheting grip assembly includes a pair of opposed, spaced, interconnected, and toothed rails. The ratcheting grip assembly includes a bracket coupled between the rails and is slidable therealong. The bracket has an upper portion with a recess formed thereon and an upper pair of spring-loaded pins extended oppositely inwards to the recess. The bracket has a lower portion with a lateral primary bore disposed therethrough, a pair of lateral opposed secondary bores disposed therethrough on each side of the primary bore, and a lower pair of spring-loaded pins extended oppositely outwards therefrom. In addition, the bracket has an intermediate portion with a channel formed therein that is extended downwards from the recess to the bore.

The ratcheting grip assembly includes an elongated and axially rotatable beam that is extended between the rails and through the primary bore of the bracket. The beam has a rear end with a finger formed thereon that is located within the rearward compartment, a front end with a handle formed thereon that is located within the forward compartment, an intermediate portion therebetween that is extended through the intermediate wall of the platform, and another finger formed thereon that is located within the rearward compartment at a location near the intermediate wall. Reciprocation of the beam by its handle allows the fingers to simultaneously project upwards through the top opening of the platform in one position and sideways in another position.

The ratcheting grip assembly includes a pair of axially rotatable levers positioned on opposite sides of the beam. Each lever has a rear end disposed within one of the secondary bores of the bracket and positioned in juxtaposition with one of the lower pair of pins, a front end with a handle formed thereon that is located within the forward compartment, and an intermediate portion therebetween that is extended through the intermediate wall of the platform.

Reciprocation the levers by their handles allow the lower pair of pins to project outwards to hold the bracket in a fixed position relative to the rails.

The ratcheting grip assembly includes a rotatable gear that is disposed within the recess of the bracket. The gear is secured to the bracket with a downwardly extended spring-loaded pin that is removably seated within the channel. The ratcheting grip assembly also includes a pair of J-shaped gripper arms. Each gripper arm has an inboard elongated toothed portion. The inboard portion is positioned in mesh with the gear. Each gripper arm also has an outboard portion with a lower extent that is disposed through one of the slots of the platform. The outboard portion of each gripper arm is terminated at an upper abutment portion that is located above the top opening. Lastly, the ratcheting grip assembly includes a peg that is disposed within the channel of the bracket. The peg has a lower end that is held in contact with the beam and an upper end that is positioned against the pin of the gear. The upper end of the peg is engagable with the gear to preclude movement of the gear and thus prevent movement of the gripper arms when the handle of the beam is positioned such that its fingers face upward.

A planar rectangular base plate is also provided and disposed over the rearward compartment. The base plate is coupled to the platform to cover the ratcheting grip assembly and yet allows projection of its fingers therethrough. The base plate is used for holding the laptop computer. The abutment portions of the gripper arms are positionable in contact against the laptop computer. The fingers are positionable upward against the laptop computer through reciprocation of the beam by its handle to hold the laptop computer in a fixed position. Lastly, a lockable door is provided. The door is hingably coupled to the platform and closable over the forward compartment. The door precludes access to the handles of the beam and the levers as well as the head portions of the clamps, thereby precluding the laptop computer which is fixed in place from being released by disengagement of the clamps and the gripper arms.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved desktop security locking station for a laptop computer or similarly sized computer peripheral which has all the advantages of the prior art computer and computer peripheral locking devices and none of the disadvantages.

It is another object of the present invention to provide a new and improved desktop security locking station for a laptop computer or similarly sized computer peripheral which may be easily and efficiently manufactured and marketed.

It is a further object of the present invention to provide a new and improved desktop security locking station for a laptop computer or similarly sized computer peripheral which is of durable and reliable construction.

An even further object of the present invention is to provide a new and improved desktop security locking station for a laptop computer or similarly sized computer peripheral which is susceptible of a low cost of manufacture with regard to both materials and labor, and which accordingly is then susceptible of low prices of sale to the consuming public, thereby making such a desktop security locking station for a laptop computer or similarly sized computer peripheral economically available to the buying public.

Still yet another object of the present invention is to provide a new and improved desktop security locking station for a laptop computer or similarly sized computer peripheral which provides in the apparatuses and methods of the prior art some of the advantages thereof, while simultaneously overcoming some of the disadvantages normally associated therewith.

Even still another object of the present invention is to provide a new and improved desktop security locking station for a laptop computer or similarly sized computer peripheral for preventing a laptop computer or a computer peripheral from being moved by an unauthorized person and thereby deterring its theft.

Lastly, it is an object of the present invention to provide a new and improved desktop security locking station for a laptop computer or similarly sized computer peripheral comprising a generally rectangular box-shaped platform having an open forward compartment and an open rearward compartment; clamping means coupled to and extended downwards from a forward extent of the platform for securing the platform to a recipient object and with the clamping means being securable and releasable by access through the forward compartment only; a base plate disposed over the rearward compartment and coupled to the platform for holding a laptop computer; ratcheting grip assembly means disposed within the compartments of the platform and extended upwards for holding a laptop computer in a fixed position and with the ratcheting grip assembly means being securable and releasable by access through the forward compartment only; and a lockable door hingably coupled to the platform and closable over the forward compartment to preclude access to the clamping means and the ratcheting grip assembly means, thereby precluding the laptop computer which is fixed in place from being released.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
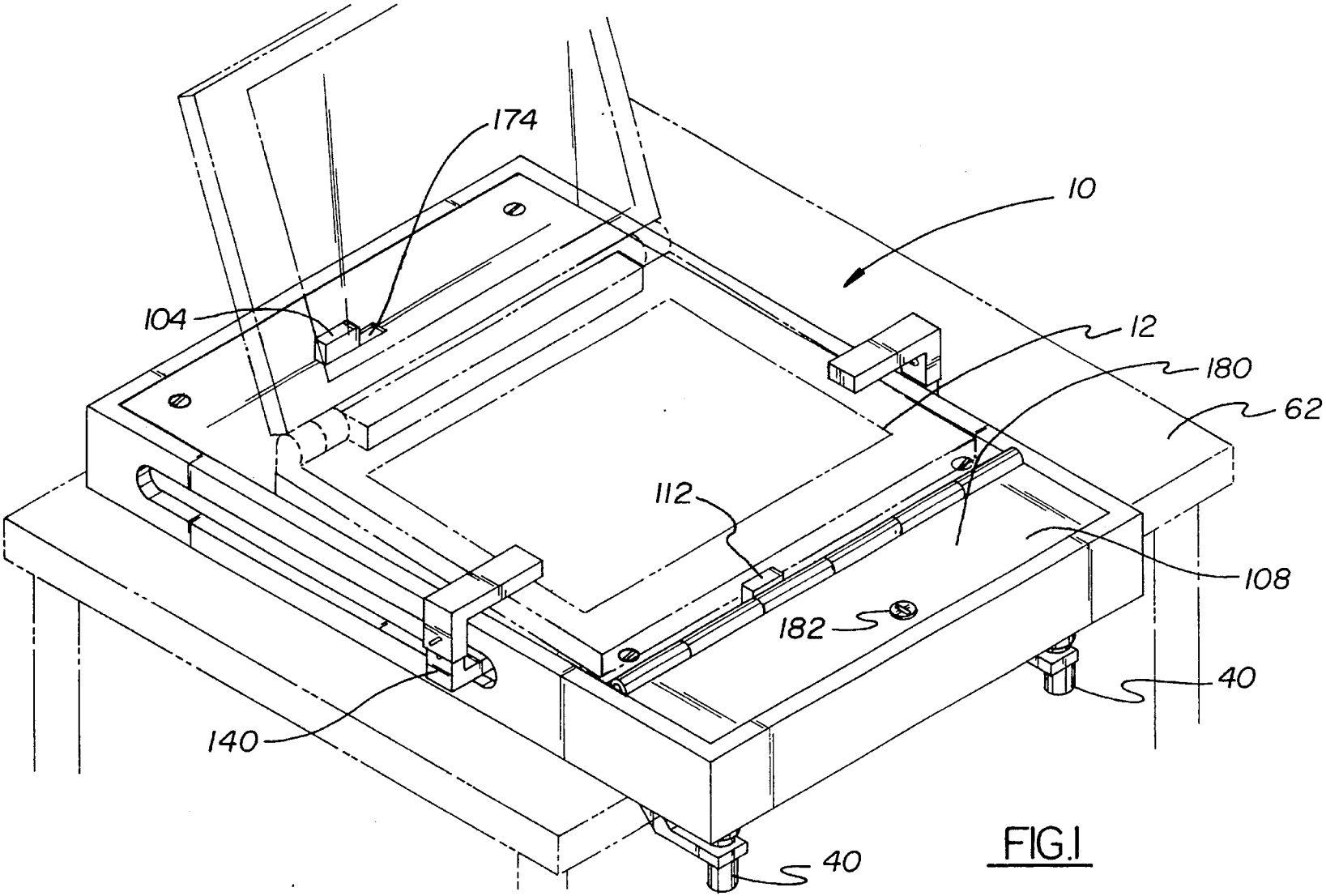
FIG. 1 is a perspective view of the preferred embodiment constructed in accordance with the principles of the present invention holding a laptop computer in place.

With reference now to the drawings, and in particular, to FIG. 1 thereof, the preferred embodiment of the new and improved desktop security locking station for a laptop computer or similarly sized computer peripheral embodying the principles and concepts of the present invention and generally designated by the reference number 10 will be described.

The preferred embodiment of the present invention comprises a plurality of components. In their broadest context, such components include a platform, clamps, and a ratcheting grip assembly. Such components are individually configured and correlated with respect to each other for fixedly locking a laptop computer 12 or similarly sized computer peripheral to a fixed location.

Figure 2:
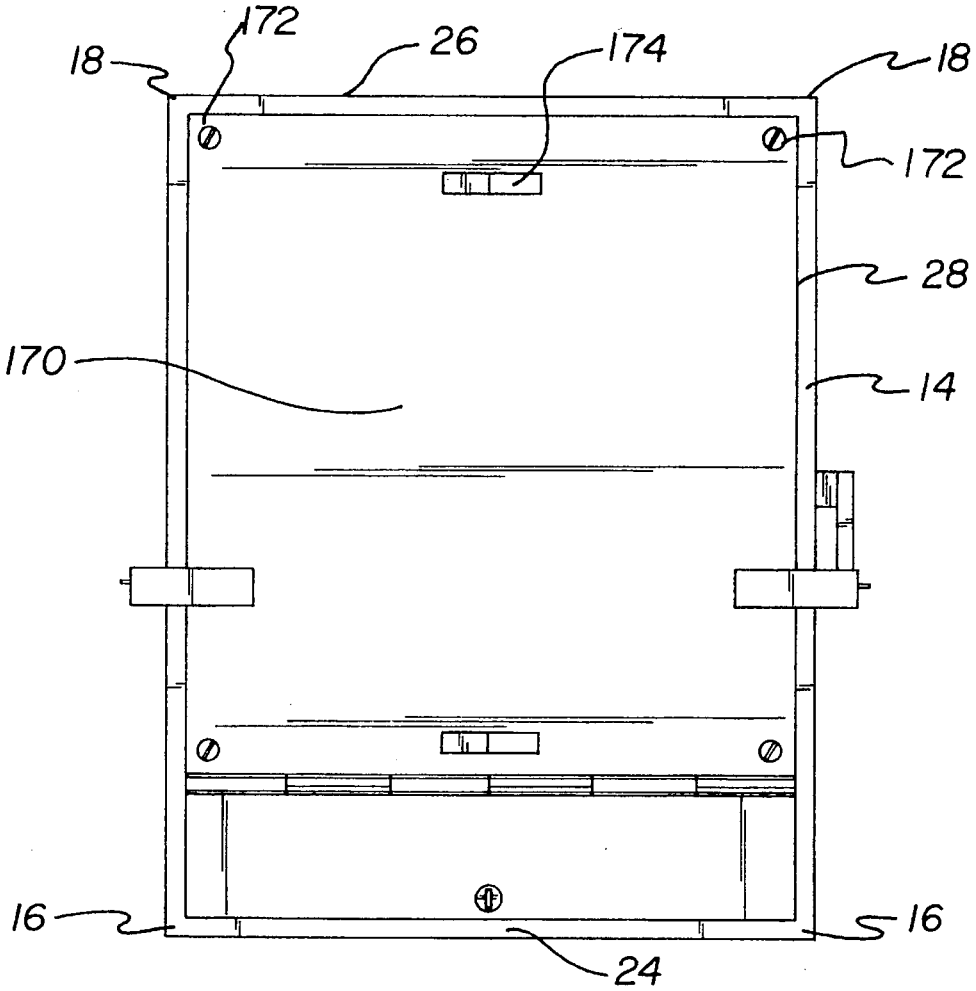
FIG. 2 is a front plan view of the preferred embodiment of the present invention.
Figure 3:
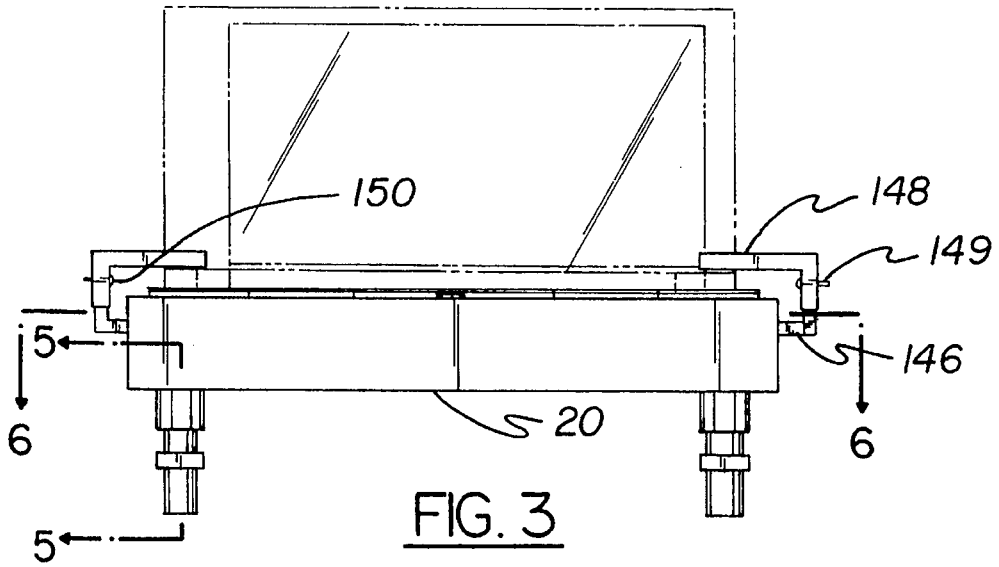
FIG. 3 is a side-elevational view of the preferred embodiment of the present invention.
Figure 4:
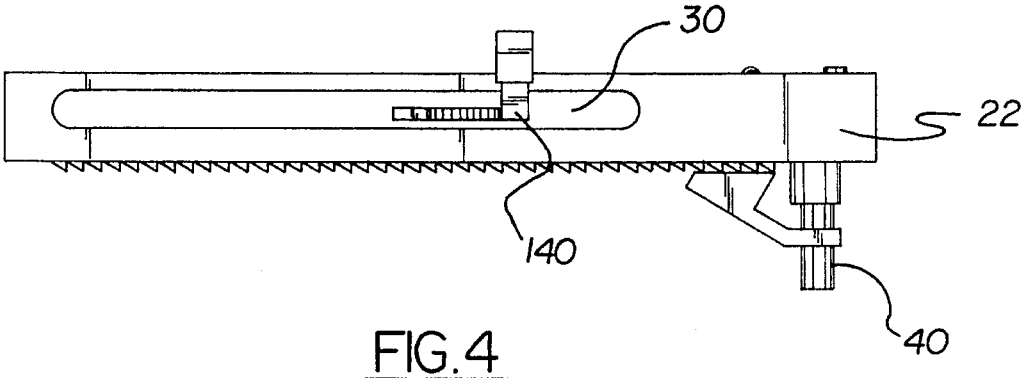
FIG. 4 is yet another side-elevational view of the preferred embodiment of the present invention.
Figure 6:
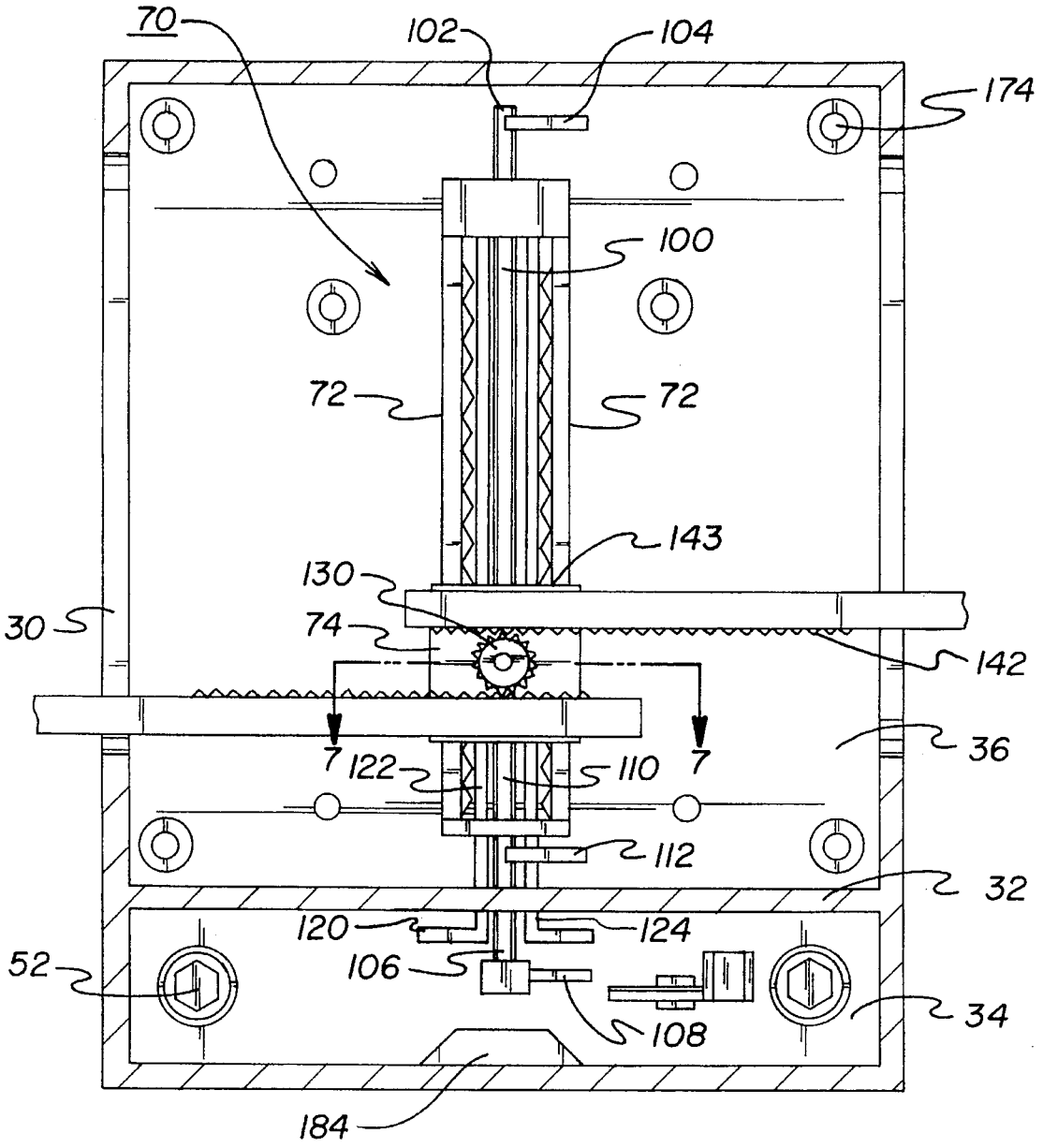
FIG. 6 is a cross-sectional view of the present invention taken along the line 6—6 of FIG. 3.

Specifically, as shown in FIGS. 2 through 4, the present invention includes a rigid platform 14. The platform has a rectangular and box-shaped structure. The platform 14 has a pair of front corners 16 and a pair of rear corners 18. The platform also has a bottom wall 20 with a pair of long side walls 22, a short front wall 24, and a short back wall 26 extending upwards therefrom to define a hollow interior and a top opening 28 for allowing access to the interior. Each side wall of the platform has an elongated oblong slot 30 formed thereon. The slots 30 extend along a substantial length of the sidewalls and are aligned about a common axis of symmetry. As shown in FIG. 6, the platform also has an intermediate wall 32 that is extended between and coupled to the long walls 22. The intermediate wall thus divides the interior of the platform into a rectangular open forward compartment 34 and a rectangular open rearward compartment 36.

Figure 5:
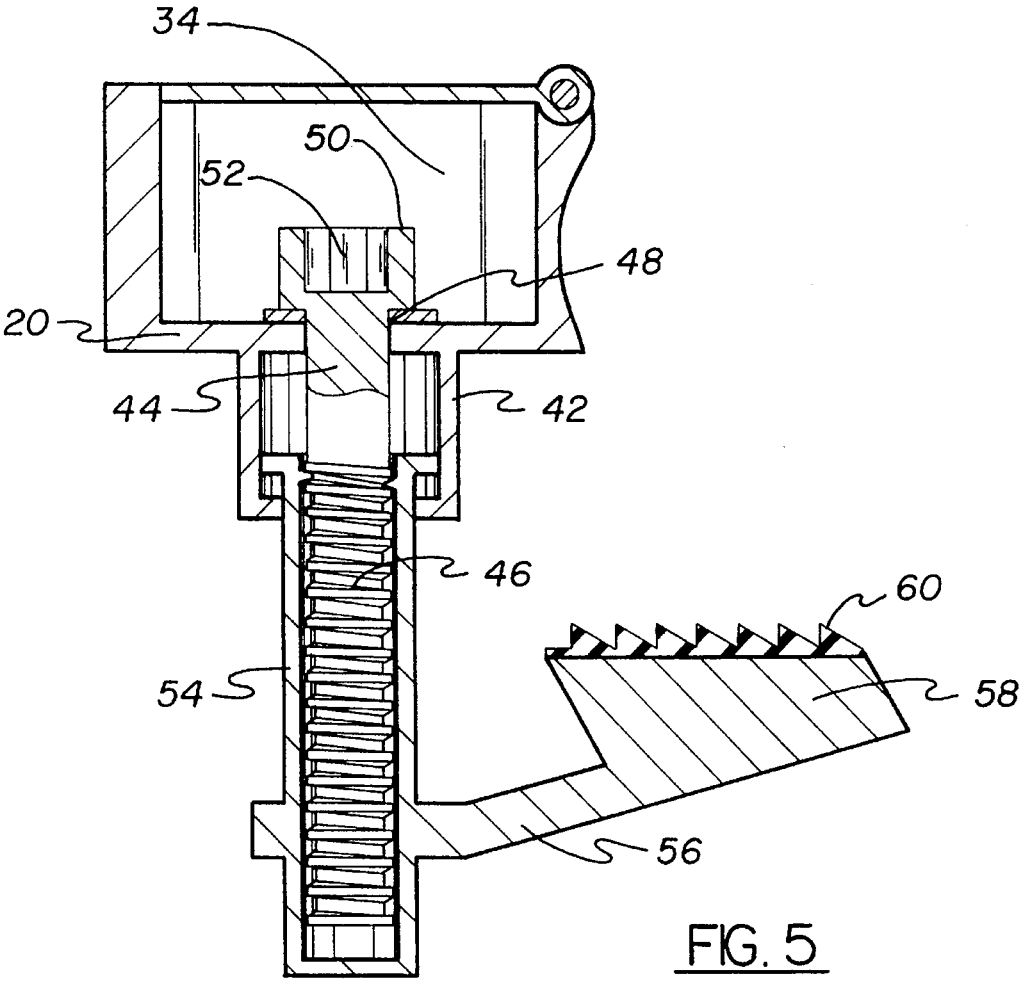
FIG. 5 is a cross-sectional view of the present invention taken along the line 5—5 of FIG. 3.

As best illustrated in FIGS. 1 and 5, the security locking station includes a pair of adjustable clamps 40. The clamps are extended downwards from each front corner 16 of the platform 14. Each clamp has a downwardly extended rigid tubular seat portion 42 that is integral with the bottom wall 20 of the platform. A rigid bolt 44 is provided. The bolt has a lower threaded portion 46 that is extended downwards through a bore 48 on the bottom wall 20 and through the seat portion 42. The bolt also has an upper head portion 50 that is extended upwards into the forward compartment 34. An engagement socket 52 is formed on the head portion for receiving a conventional wrench or screwdriver. In addition, the clamp includes a rigid sleeve portion 54 that is telescopically disposed within the seat portion and threadably engaged with the threaded portion 46 of the bolt. Each clamp also includes a rigid clamping arm 56 that is integral with and extended upwards from the sleeve portion. Each clamping arm has an upper portion 58 with a rubber gripping surface 60 adhered thereto. The head portion 50 of each bolt 44 is tightenable for allowing the associated clamping arm 40 to move upwards for clamping an object such as a desktop 62 that is positioned between it and the bottom wall of the platform. When tightened in such a matter, the platform is fixedly held to the desktop.

Figure 7:
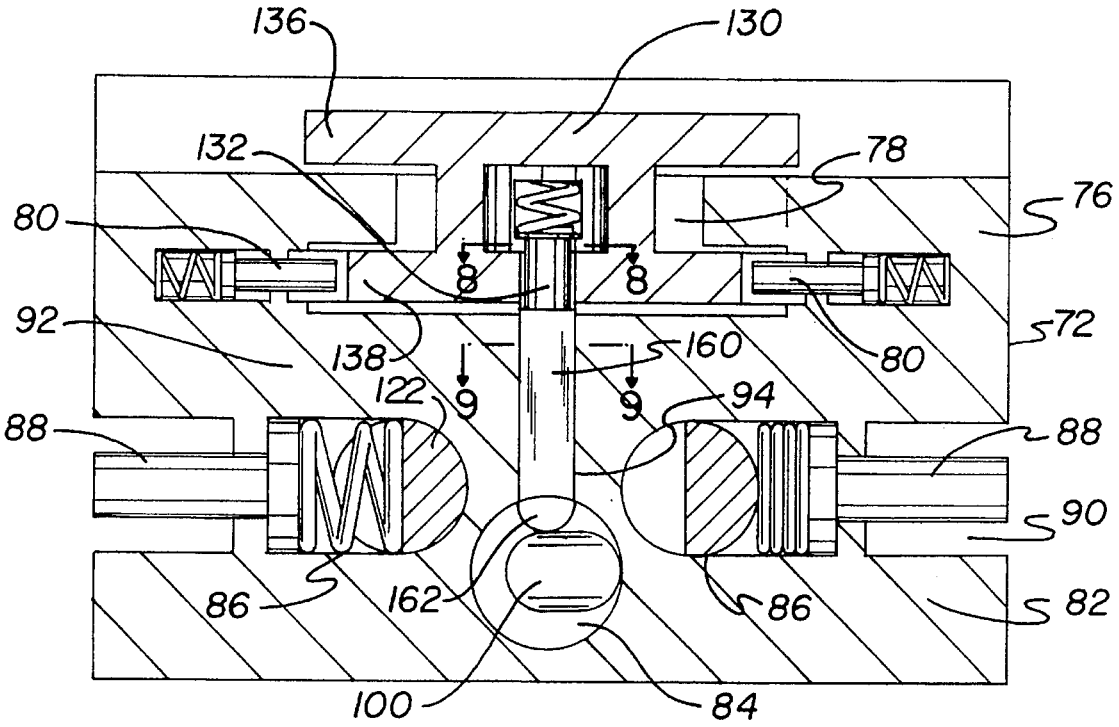
FIG. 7 is a cross-sectional view of the present invention taken along the line 7—7 of FIG. 6.

Also provided is a ratcheting grip assembly 70 as shown in FIG. 6. The ratcheting grip assembly is used for holding a laptop computer or similarly sized computer peripheral at a fixed position upon the platform 14. The ratcheting grip assembly is extended within the interior of the platform and across its compartments 34, 36. The ratcheting grip assembly includes a pair of opposed, spaced, interconnected and toothed rigid rails 72. In addition, as best illustrated in FIGS. 6 and 7, the ratcheting grip assembly includes a rigid bracket 74. The bracket is coupled between the rails 72 and slidable therealong. The bracket has an upper portion 76 with a recess 78 formed thereon. In addition, an upper pair of rigid and spring-loaded pins 80 is extended oppositely inwards from the bracket to the recess. The bracket also has a lower portion 82 with a lateral primary bore 84 extended therethrough. The bore 84 has a generally circular cross-section. A pair of laterally opposed secondary bores 86 are disposed through the bracket on each side of the primary bore 84. Furthermore, a lower pair of rigid and spring-loaded pins 88 is extended oppositely outwards from the bracket. Each pin 88 is positionable within a groove 90. Each groove 90 is used for receiving one of the rails 72. Lastly, the bracket includes an intermediate portion 92 with a channel 94 formed therein. The channel has a square cross-section and is extended downwards from the recess 78 to the bore 84.

The ratcheting grip assembly also includes an elongated and axially rotatable rigid beam 100. The beam has an elliptical cross-section and is positioned between the rails 72 and through the primary bore 84 of the bracket 74. The beam 100 has a rear end 102 with a rigid elongated finger 104 formed thereon. Finger 104 is located within the rearward compartment 36. The beam also has a front end 106 with a handle 108 formed thereon. The handle 108 is located within the forward compartment 34. An intermediate portion 110 of the beam is extended between the ends 102, 106 and through the intermediate wall 32 of the platform. In addition, an elongated finger 112 is formed on the intermediate portion and is located within the rearward compartment 36 near the intermediate wall. The fingers are aligned in a common plane. When the beam 100 is reciprocated with the handle 108, the fingers 104, 112 simultaneously project upward through the top opening 28 of the platform in one position or sideways in another position.

The ratcheting grip assembly 70 also includes a pair of elongated and axially rotatable rigid levers 120. The levers 120 are positioned on opposite sides of the beam 100. Each lever has a rear end 122 that is disposed within one of the secondary bores 86 of the bracket. Each rear end 122 is positioned in contact or juxtaposition with one of the lower spring-loaded pins 88. Each rear end 122 of each lever has a generally crescent-shaped cross-section. Each lever also has a front end with a handle 124 formed thereon. The handles 124 are located within the forward compartment 34. Each lever further includes an intermediate portion that is extended between the handle 124 and the rear end 122 and through the intermediate wall 32 of the platform. Reciprocation of the levers by the handles 124 allow the lower pins 88 to project outwards to hold the bracket in a fixed position relative to the rails or allows free movement of the bracket.

Figure 8:
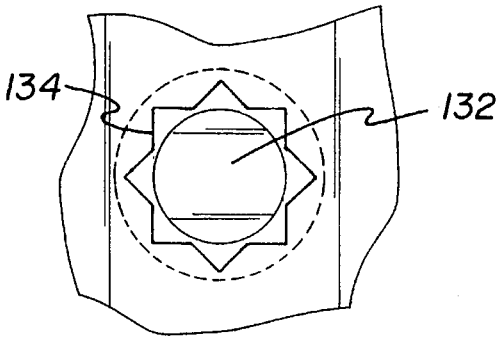
FIG. 8 is a cross-sectional view of the present invention taken along the line 8—8 of FIG. 7.

In addition, a rotatable rigid gear 130 is disposed within the recess 78 of the bracket. The gear 130 is secured to the bracket with a downwardly extending and rigid spring-loaded pin 132. The pin is removably seated within the channel 94. As shown in FIG. 8, the pin is slidably positioned in a bore 134 that is bounded by sixteen faces. These faces are formed by a square primary aperture and a square secondary aperture that is axially offset approximately 45 degrees from the primary aperture. The gear has an upper set of teeth 136 and a lower set of teeth 138 that are engaged with the upper pair of pins 80.

The ratcheting grip assembly also has a pair of J-shaped gripper arms 140 as shown in FIG. 1. Each gripper arm has an inboard elongated rigid toothed portion 142 as shown in FIG. 6. The toothed portion 142 is positioned in mesh with the upper set of teeth 136 of the gear 130 and held in place by a rigid guide plate 143. Each gripper arm also has a rigid outboard portion with a lower extent 146. The lower extent 146 is disposed through one of the slots 30 of the platform as shown in FIGS. 3 and 4 and terminated at an upper abutment portion 148. The upper abutment portion 148 is located above the top opening 28. In addition, the upper abutment portion is telescopically extendable from the lower extent 146 and setable at a fixed position through tightening of a threaded bolt 149. The head 150 of the bolt 149 is positioned such that it cannot be accessed when the gripper arms are pressed against a laptop computer or peripheral.

Figure 9:
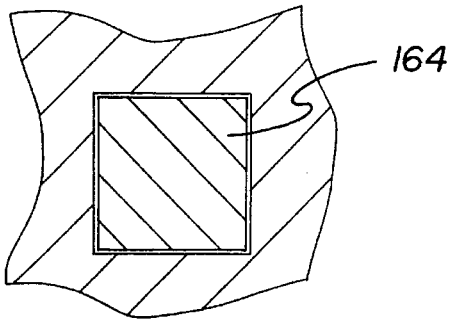
FIG. 9 is a cross-sectional view of the present invention taken along the line 9—9 of FIG. 7.

Lastly, the ratcheting grip assembly 70 includes a rigid peg 160. The peg is disposed within the channel 94 of the bracket. The peg has a lower rounded end 162 that is held in contact with the beam 100. The peg also has an upper end 164 with a square cross-section that is positionable against the pin 132 of the gear as shown in FIG. 9. The upper end of the peg 164 is engagable with the spring-loaded pin 132 of the gear to force it upwards. The upper end 164 is then seated in the bore 134, thus precluding movement of the gear 130. When the upper end 164 of the pin is seated in this manner, movement of the gripper arms 140 is prevented. The upper end 164 of the pin is placed in the seated position when the handle 108 of the beam is positioned such that the fingers 104, 108 face upward. The elliptical shape of the beam acts as a cam for pushing the peg upwards or allowing it to be released downwards when the handle is actuated.

As shown in FIG. 2, a rigid planar rectangular base plate 170 is disposed over the rearward compartment 36. The base plate is coupled to the platform with bolts 172 that are secured within threaded apertures 174 formed on the bottom wall 20. The base plate substantially covers the ratcheting grip assembly 70 and yet allows projection of the fingers 104, 112 through egress holes 176. The top surface of the base plate is held at a level essentially flush with the top edge of the platform and is used for holding a laptop computer 12 or peripheral thereon. In an alternate embodiment, the base plate could be recessed slightly in order to create a recessed seat in which the laptop or peripheral could be placed.

When the present invention is in operation, the abutment portions 148 of the arms are positionable in contact against an upper portion of a laptop computer and the fingers 104, 112 are positioned upward against a lower portion of the laptop computer through reciprocation of the beam 100 by its handle 108. The laptop computer is thus held in a fixed position on the base plate. Lastly, the platform includes a door 180 that is hingably coupled to the platform and closable over the forward compartment 34. The door includes a locking mechanism 182 that is engagable with a latch 184 to preclude access to the handles 108 of the beam, the handles 124 of the levers, and the head portions 50 of the clamps. By precluding access to these components, the laptop computer can remain fixed in place. The door is positioned close to the handles when closed, thus precluding their possible movement.

The present invention is a security device designed to deter theft of portable computers and portable computer peripherals such as printers and fax machines. The present invention is a lightweight and portable platform that can be easily yet securely fastened to the front edge of a table or desk top. A user's portable computer is then secured to the present invention using the special grip assembly.

A locking cover or base plate on the platform gives an owner access to the adjustable clamping mechanism. The clamps can be tightened to fit surfaces ranging from about ½ inch to 3 inches in thickness. The special design of these clamps will prevent dislodging of the present invention by an individual prying or pulling while its durable rubber gripping surfaces will not damage a furniture finish.

A laptop computer is secured to the present invention by adjusting the grip assembly mechanism. The ratcheting mechanism allows longitudinal movement of the arms for optimal positioning against a computer. The gripper arms of the grip assembly mechanism are adjusted to fit snugly against the upper surface of the computer. Next, the handles of the beams and lever are actuated to stop transverse movement of the gripper arms within the slots and force the fingers upward against the computer, thereby holding the computer in a fixed position. The present invention can be permanently installed upon a workstation or desktop if desired. The lock on the present invention precludes tampering with the handles for releasing the computer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A desktop security locking station for a laptop computer comprising, in combination:

a rectangular box-shaped platform having a pair of front corners, a pair of rear corners, and a bottom wall with a pair of long side walls, a short front wall, and a short back wall extending upwards therefrom to define a hollow interior and a top opening, and with each side wall having an elongated slot formed thereon, the platform further having an intermediate wall extended between the long walls to divide the interior into an open forward compartment and an open rearward compartment;

a pair of adjustable clamps extended downwards from each front corner of the platform, each clamp having a downwardly extended tubular seat portion integral with the bottom wall of the platform, a bolt having a lower threaded portion extended downwards through the bottom wall and the seat portion and an upper head portion extended upwards into the forward compartment, a sleeve portion telescopically disposed within the seat portion and threadably engaged with the threaded portion of the bolt, and a clamping arm integral with and extending outwards from the sleeve portion, and with the head portion of each bolt tightenable for allowing the associated clamping arm to move upwards for clamping an object positioned between the clamping arm and the bottom wall of the platform;

a ratcheting grip assembly disposed within the interior of the platform and comprising:

a pair of opposed, spaced, interconnected, and toothed rails, a bracket coupled between the rails and slidable therealong, the bracket having an upper portion with a recess formed thereon and an upper pair of spring-loaded pins extended oppositely inwards to the recess, a lower portion with a lateral primary bore disposed therethrough, a pair of lateral opposed secondary bores disposed therethrough on each side Of the primary bore, and a lower pair of spring-loaded pins extended oppositely outwards therefrom, and an intermediate portion with a channel formed therein that is extended downwards from the recess to the primary bore, an elongated and axially rotatable beam extended between the rails and through the primary bore of the bracket, the beam having a rear end with a finger formed thereon that is located within the rearward compartment, a front end with a handle formed thereon that is located within the forward compartment, an intermediate portion therebetween that is extended through the intermediate wall of the platform, and another finger formed thereon that is located within the rearward compartment near the intermediate wall, and with reciprocation of the beam by the handle allowing the fingers to project upwards through the top opening of the platform in one position and sideways in another position, a pair of elongated and axially rotatable levers positioned on opposite sides of the beam, each lever having a rear end disposed within one of the secondary bores of the bracket and positioned in juxtaposition with one of the lower pair of pins, a front end with a handle formed thereon that is located within the forward compartment, and an intermediate portion therebetween that is extended through the intermediate wall of the platform, and with the reciprocation of the levers by the handles allowing the lower pair of pins to project outwards to hold the bracket in a fixed position relative to the rails, a rotatable gear disposed within the recess of the bracket and secured thereto with a downwardly extended spring-loaded pin that is removably seated within the channel, a pair of J-shaped gripper arms, each gripper arm having an inboard elongated toothed portion positioned in mesh with the gear and an outboard portion with a lower extent disposed through one of the slots of the platform and terminated at an upper abutment portion that is located above the top opening, and a peg disposed within the channel of the bracket, the peg having a lower end in contact with the beam and an upper end positionable against the pin of the gear and with the upper end of the peg engagable with the gear to thereby preclude movement of the gear and thus prevent movement of the gripper arms when the handle of the beam is positioned such that the fingers of the beam face upward;

a planar rectangular base plate disposed over the rearward compartment and coupled to the platform to cover the ratcheting grip assembly and yet allow projection of the fingers therethrough, and with the Upper abutment portions of the arms positionable in contact against a laptop computer placed upon the base plate and the fingers positionable upward against the laptop computer through reciprocation of the beam by the handle of the beam to hold the laptop computer in a fixed position; and a lockable door hingably coupled to the platform and closable over the forward compartment to preclude access to the handles of the beam and the levers as well as the head portions of the clamps, thereby precluding the laptop computer which is fixed in place from being released by disengaging the clamps and the gripper arms.

2. A desktop security locking station for a laptop computer or similar sized computer peripheral comprising, in combination:

a generally rectangular box-shaped platform having an open forward compartment and an open rearward compartment;

clamping means coupled to and extended downwards from a forward extent of the platform for securing the platform to a recipient object and with the clamping means being securable and releasable by access through the forward compartment only;

a base plate disposed over the rearward compartment and coupled to the platform for holding a laptop computer;

ratcheting grip assembly means disposed within the compartments of the platform and extended upwards above the base plate for holding a laptop computer in a fixed position and with the ratcheting grip assembly means being securable and releasable by access through the forward compartment only; and a lockable door hingably coupled to the platform and closable over the forward compartment to preclude access to the clamping means and the ratcheting grip assembly means, thereby precluding the laptop computer, which is fixed in place, from being released.

3. The desktop security locking station as set forth in claim 2:

wherein the clamping means is formed of a pair of clamps;

and wherein each clamp includes a downwardly extended tubular seat portion integral with the platform, a bolt having a lower threaded portion extended downwards through the seat portion and an upper head portion extended upwards into the forward compartment, a sleeve portion telescopically disposed within the seat portion and threadably engaged with the threaded portion of the bolt, and a clamping arm integral with and extending outwards from the sleeve portion, and with the head portion of each bolt tightenable for allowing the associated clamping arm to move upwards for clamping an object positioned between the clamping arm and the platform.

4. The desktop security locking station as set forth in claim 2 wherein the ratcheting grip assembly means comprises:

a pair of opposed spaced and toothed rails;

a bracket coupled between the rails and slidable thereal-ong, the bracket having an upper portion with a recess formed thereon and an upper pair of spring-loaded pins extended oppositely inwards to the recess, a lower portion with a lateral primary bore disposed therethrough, a pair of lateral opposed secondary bores disposed therethrough on each side of the primary bore, and a lower pair of spring-loaded pins extended oppositely outwards therefrom, and an intermediate portion with a channel formed therein that is extended downwards from the recess to the primary bore;

an elongated and axially rotatable beam extended between the rails and through the primary bore of the bracket, the beam having a rear end with a finger formed thereon that is located within the rearward compartment, a front end with a handle formed thereon that is located within the forward compartment and another finger formed thereon that is located within the rearward compartment, and with reciprocation of the beam by the handle allowing the fingers to project upwards through a top opening of the platform in one position and sideways in another position;

a pair of elongated and axially rotatable levers positioned on opposite sides of the beam, each lever having a rear end disposed within one of the secondary bores of the bracket and positioned in juxtaposition with one of the lower pair of pins and a front end with a handle formed thereon that is located within the forward compartment, and with the reciprocation of the levers by the handles allowing the lower pair of pins to project outwards to hold the bracket in a fixed position relative to the rails;

a rotatable gear disposed within the recess of the bracket and secured thereto with a downwardly extended spring-loaded pin that is removably seated within the channel;

a pair of J-shaped gripper arms, each gripper arm having an inboard elongated toothed portion positioned in mesh with the gear and an outboard portion terminated at an upper abutment portion that is located above the top opening of the platform; and a peg disposed within the channel of the bracket, the peg having a lower end in contact with the beam and an upper end positionable against the pin of the gear and with the upper end of the pin engagable with the gear to thereby preclude movement of the gear and thus prevent movement of the gripper arms when the handle of the beam is positioned such that the fingers of the beam face upward.

* * * * *